US007035379B2

(12) United States Patent
Turner et al.

(10) Patent No.: US 7,035,379 B2
(45) Date of Patent: Apr. 25, 2006

(54) RADIATION WINDOW AND METHOD OF MANUFACTURE

(75) Inventors: D. Clark Turner, Payson, UT (US); Keith W. Decker, Pleasant Grove, UT (US); M. Christine Roberts, Herriman, UT (US); Robert N. Stillwell, Lindon, UT (US)

(73) Assignee: Moxtek, Inc., Orem, UT (US)

( * ) Notice: Subject to any disclaimer, the term of this patent is extended or adjusted under 35 U.S.C. 154(b) by 262 days.

(21) Appl. No.: 10/662,053

(22) Filed: Sep. 12, 2003

(65) Prior Publication Data

US 2004/0120466 A1 Jun. 24, 2004

Related U.S. Application Data

(60) Provisional application No. 60/410,517, filed on Sep. 13, 2002.

(51) Int. Cl.
*H01J 35/18* (2006.01)

(52) U.S. Cl. ..... 378/140; 378/161

(58) Field of Classification Search ..... 378/140, 378/161

See application file for complete search history.

(56) References Cited

U.S. PATENT DOCUMENTS

| | | | | |
|---|---|---|---|---|
| 4,160,311 | A | 7/1979 | Ronde et al. | 445/37 |
| 4,463,338 | A | 7/1984 | Utner et al. | 338/281 |
| 5,010,562 | A | 4/1991 | Hernandez et al. | 378/125 |
| 5,117,829 | A | 6/1992 | Miller et al. | 600/427 |
| 5,161,179 | A | 11/1992 | Suzuki et al. | 378/161 |
| 5,226,067 | A * | 7/1993 | Allred et al. | 378/161 |
| RE34,421 | E | 10/1993 | Parker et al. | 378/121 |
| 5,391,958 | A | 2/1995 | Kelly | 313/420 |
| 5,400,385 | A | 3/1995 | Blake et al. | 378/110 |
| 5,428,658 | A | 6/1995 | Oettinger et al. | 378/119 |
| 5,478,266 | A | 12/1995 | Kelly | 445/43 |
| RE35,383 | E | 11/1996 | Miller et al. | 378/138 |
| 5,621,780 | A | 4/1997 | Smith et al. | 378/65 |
| 5,729,583 | A | 3/1998 | Tang et al. | 378/122 |
| 6,005,918 | A | 12/1999 | Harris et al. | 378/140 |
| 6,044,130 | A | 3/2000 | Inazura et al. | 378/138 |
| 6,069,278 | A | 5/2000 | Chuang | 564/418 |
| 6,075,839 | A | 6/2000 | Treseder | 378/140 |
| 6,097,790 | A | 8/2000 | Hasegawa et al. | 378/161 |
| 6,133,401 | A | 10/2000 | Jensen | 528/170 |

(Continued)

FOREIGN PATENT DOCUMENTS

JP 05066300 A * 3/1993

*Primary Examiner*—David V. Bruce
*Assistant Examiner*—Courtney Thomas
(74) *Attorney, Agent, or Firm*—Thorpe North & Western

(57) ABSTRACT

A radiation window device to transmit radiation as part of an x-ray source or detector includes a support to be subject to a substantial vacuum, and an opening configured to transmit radiation. A film is mounted directly on the support across the opening, and has a material and a thickness selected to transmit soft x-rays. An adhesive directly adheres the film to the support. A coating covers exposed portions of at least one of the evacuated or ambient sides of the film, and covers a portion of the support surrounding the film. The support, film and adhesive form a vacuum tight assembly capable of maintaining the substantial vacuum when one side is subject to the substantial vacuum. In addition, the vacuum tight assembly can withstand a temperature of greater than approximately 250 degrees Celsius.

31 Claims, 2 Drawing Sheets

U.S. PATENT DOCUMENTS

| | | | | |
|---|---|---|---|---|
| 6,134,300 | A | 10/2000 | Trebes et al. | 378/136 |
| 6,184,333 | B1 | 2/2001 | Gray | 528/170 |
| 6,288,209 | B1 | 9/2001 | Jensen | 528/353 |
| 6,307,008 | B1 | 10/2001 | Lee et al. | 528/353 |
| 6,320,019 | B1 | 11/2001 | Lee et al. | 528/353 |
| 6,351,520 | B1 | 2/2002 | Inazaru | 378/138 |
| 6,477,235 | B1 | 11/2002 | Chornenky et al. | 378/138 |
| 6,487,272 | B1 | 11/2002 | Kutsuzawa | 378/140 |
| 6,546,077 | B1 | 4/2003 | Chornenky et al. | 378/122 |
| 6,661,876 | B1 | 12/2003 | Turner et al. | 378/143 |

* cited by examiner

RADIATION WINDOW AND METHOD OF MANUFACTURE

This application claims the benefit of U.S. Provisional Patent Application No. 60/410,517, filed Sep. 13, 2002.

BACKGROUND OF THE INVENTION

1. Field of the Invention

The present invention relates generally to a window for sealing a vacuum chamber and transmitting radiation or electrons.

2. Related Art

X-ray sources or x-ray detectors utilize a vacuum chamber with a window through which x-rays are transmitted. The window can be formed of beryllium foil that is typically made by rolling. The rolling can produce a mosaic of crystallites with grain boundaries that can leak gas. In the vacuum chamber, even minute amounts of gas pose a serious threat to the operation and longevity of x-ray detectors and x-ray emitters. Beryllium windows are typically made relatively thick (greater than about 23 μm) to prevent leaks. Unfortunately, the thickness of the window prevents transmission of the soft x-rays emitted by sodium and elements with even lower atomic numbers (Z). Thinner beryllium windows have proven difficult to attach to support structures without leaving leaks in the resulting assembly.

In addition, beryllium windows can develop leaks if its mounting promotes stress concentration. It has been proposed to relieve at least some of the stress concentration by mounting the beryllium window over a ring that retains its shape even when it is heated. The window can be subjected to heat during mounting or during use.

The beryllium window is typically brazed to a support structure to form a window assembly that can be attached to the vacuum chamber and processed at temperatures above 250 degrees Celsius. Brazing has proven effective for relatively thicker windows (greater than about 30 μm) windows, but not for beryllium windows thin enough to transmit the soft x-rays of interest.

An alternative is the use of an adhesive. Adhesives can still allow certain gases (e.g. oxygen) to diffuse through them when the vacuum chamber is evacuated. In addition, the window must still be thick enough to avoid leaks, and this thickness blocks the soft x-rays.

SUMMARY OF THE INVENTION

It has been recognized that it would be advantageous to develop a window for x-ray sources or detectors that can 1) be used at elevated temperatures, such as greater than 250° C., or even greater than 450° C.; 2) maintain a substantial vacuum in the vacuum chamber; and 3) transmit soft x-rays.

The invention provides a window device to transmit radiation or electrons. The window includes a support to be subject to a substantial vacuum, and that has an opening configured to transmit radiation therethrough. A film is mounted directly on the support across the opening, and has a material and a thickness selected to transmit soft x-rays. The film has an evacuated side to face the substantial vacuum, and an ambient side to face away from the substantial vacuum. An adhesive directly adheres the film to the support. A coating covers exposed portions of at least one of the evacuated or ambient sides of the film, and covers a portion of the support surrounding the film. The film, the adhesive and the coating form a vacuum tight assembly capable of maintaining the substantial vacuum when one side is subject to the substantial vacuum. In addition, the vacuum tight assembly can be capable of withstanding a temperature greater than approximately 250 degrees Celsius.

In accordance with a more detailed aspect of the present invention, the film can include a beryllium material, and has a thickness less than approximately 23 micrometers. In addition, the adhesive can include a polymeric material. Furthermore, the coating can include a boron-hydrogen composition.

The invention also provides a method for making a radiation window device. A liquid adhesive is applied to an area of contact between a film and a support, the film being capable of transmitting soft x-rays. The film is disposed on the support and across an opening in the support. A temperature greater than approximately 250 degrees Celsius is applied to the adhesive, the film and the support to cure the adhesive. A substantial vacuum can also be applied to assist in the curing process. An exposed portion of the film is coated with an organic material on at least i) an evacuated side of the film configured to face a substantial vacuum, or ii) an ambient side of the film configured to face away from the substantial vacuum.

Additional features and advantages of the invention will be apparent from the detailed description which follows, taken in conjunction with the accompanying drawings, which together illustrate, by way of example, features of the invention.

DETAILED DESCRIPTION

Figure 1:
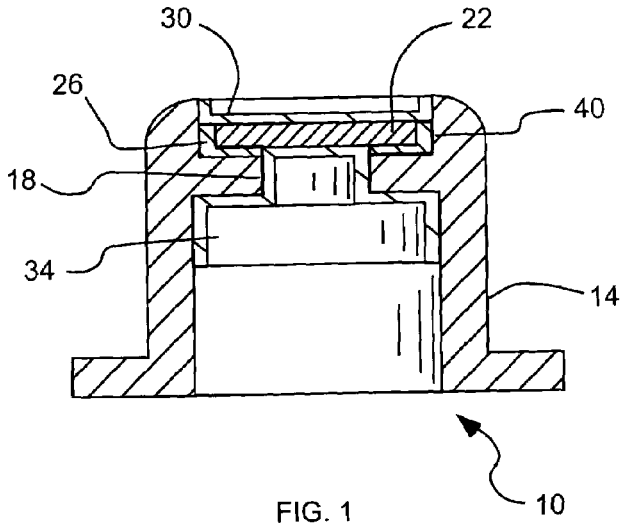
FIG. 1 is a cross-sectional schematic view of a window assembly or device in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2A:
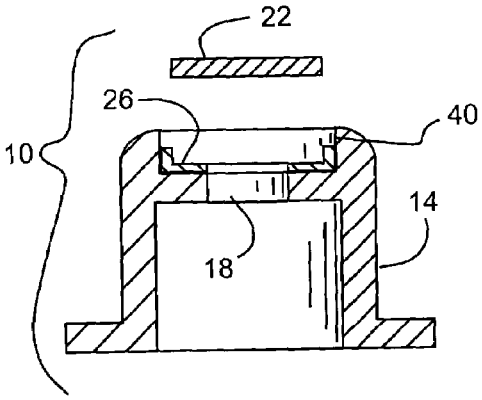
FIGS. 2*a–d* are cross-sectional schematic views of a method of making the window device of FIG. 1.
Figure 2B:
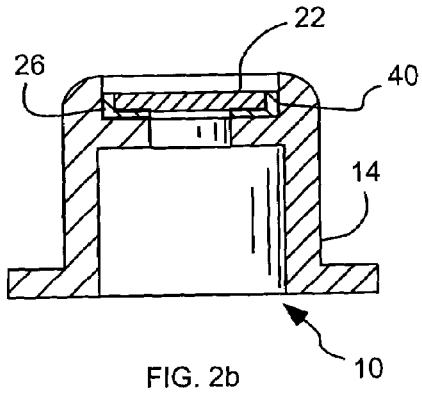
Figure 2C:
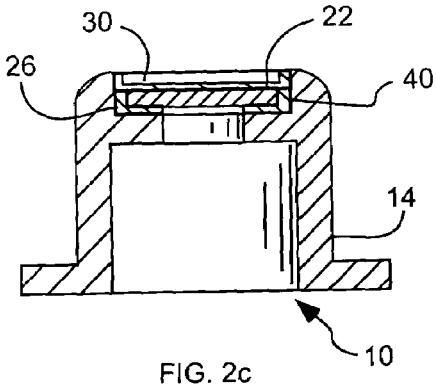
Figure 2D:
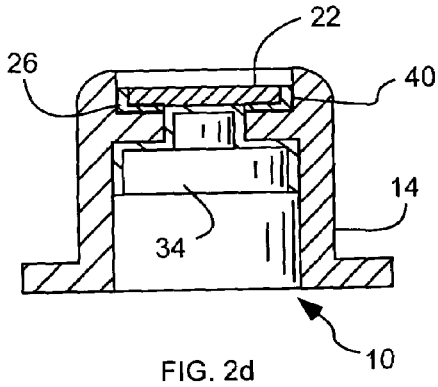
Figure 3:
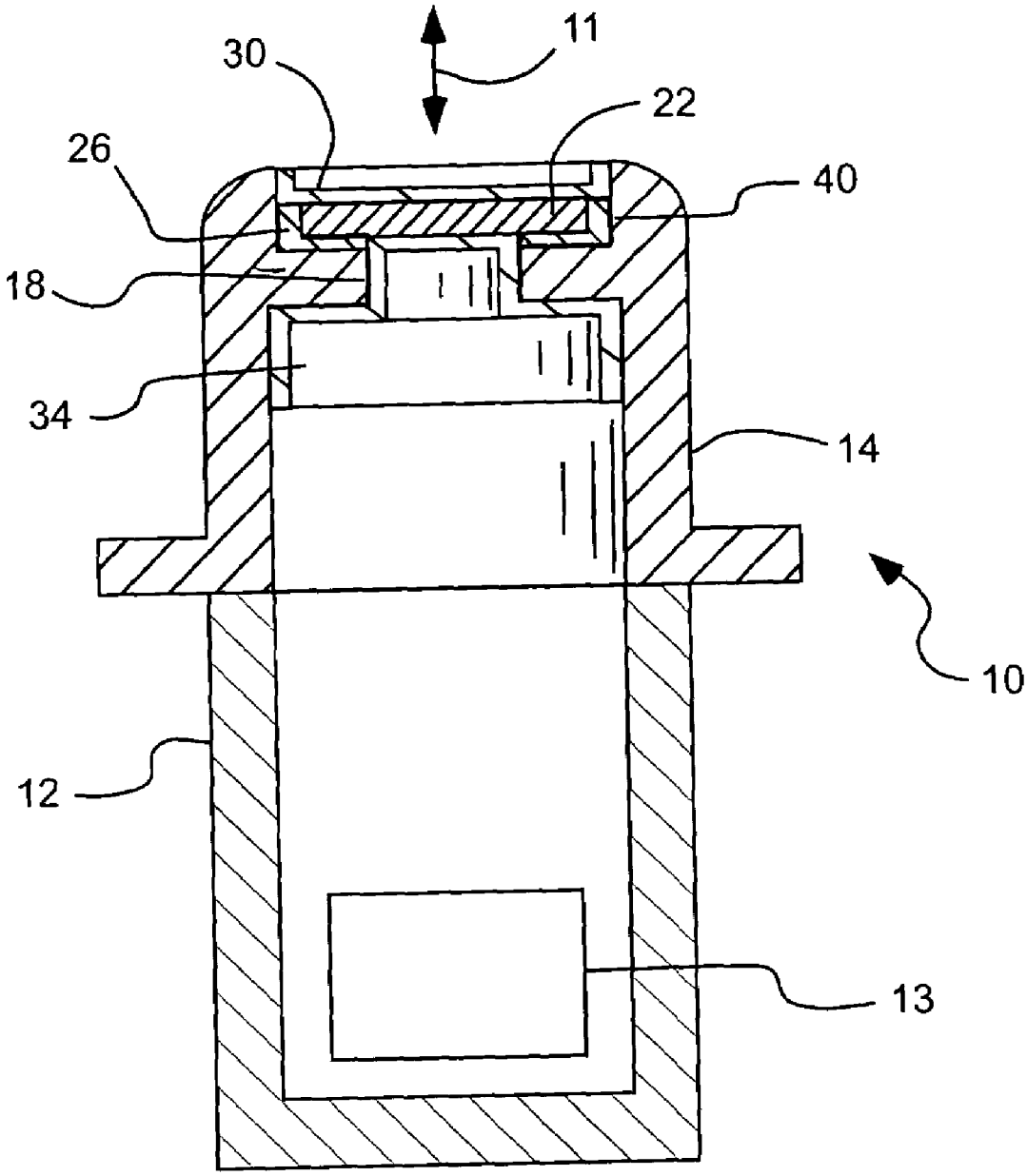
FIG. 3 is a schematic view of an x-ray source or detector utilizing the widow device of FIG. 1.

As illustrated in FIGS. 1–3, a radiation window, device or assembly, indicated generally at 10, in accordance with the present invention is shown for transmitting electrons or radiation (represented by line 11 in FIG. 3) while sealing a vacuum chamber or evacuated chamber 12. Thus, the radiation window 10 can be utilized as part of an x-ray source or an x-ray detector 13 (FIG. 3). X-ray sources and detectors are understood in the art and will not be explained in detail. It is of course understood that the radiation widow 10 can be used with other ionized radiation sources.

The radiation window 10 advantageously maintains a vacuum or resists leaking, can transmit soft x-rays emitted by low-Z elements, and can withstand applications or processing in temperatures greater than 250° C., or even greater than 450° C. An example of high temperature processing includes brazing, soldering or welding. Examples of high temperature applications include uses near flames or hot wires. There has been a long felt need for a window capable of transmitting soft x-rays, maintaining a vacuum, and withstanding high temperatures.

The radiation window 10 includes a support 14 or support structure with an opening 18 therein. The support 14 includes a wall and can form a part of the evacuated or vacuum chamber 12 (FIG. 3) of the x-ray source or detector 13 (FIG. 3). The support 14 is sized and shaped to withstand pressures associated with a vacuum on the inside, and ambient pressure on the outside. The support 14 can have a different configuration or shape than that shown in the Figures, including for example, a ring or washer configuration. The support 14 has an inside, or an evacuated side, subject to a substantial vacuum, and an outside, or an ambient side, subject to ambient pressure. An electron gun, detector or x-ray source (represented by 13 in FIG. 3) can be disposed in the chamber 12 (FIG. 3). The opening 18 allows for the transmission of electromagnetic radiation, electrons or both, including x-rays, ionized radiation, etc. in or out of the chamber.

A film 22 is disposed on the support 14, and across the opening 18, in such a way to maintain the vacuum on the inside of the chamber. The film 22 has an inside, or an evacuated side, facing the substantial vacuum, and an outside, or an ambient side, facing opposite the vacuum side. The film 22 is formed of a material and has a thickness selected to maintain the vacuum and transmit a desired electromagnetic radiation and/or electrons. In one aspect, the material and thickness of the film can transmit at least approximately 10% of F emissions (fluorine), or incident radiation having a wavelength longer than approximately 18.5 Å (angstroms), or characteristic x-ray emissions from other elements with an atomic number (Z) greater than 8, such as sodium. In addition, the material and thickness of the film can transmit at least approximately 10% of incident electrons.

For example, the film 22 can be formed of beryllium, and can have a thickness less than approximately 23 μm (micrometers). The beryllium can be a beryllium foil formed by rolling. The rolling can produce a mosaic of crystallites with grain boundaries that can leak gas. Even minute amounts of gas pose a serious threat to the operation and longevity of x-ray detectors and x-ray emitters on the evacuated side of the film or support. While thicker windows can be used to avoid leaks, a thickness greater than about 23 μm can prevent transmission of the soft x-rays, such as those emitted by sodium and certain elements with even lower atomic numbers (Z).

The beryllium may contain impurities or substantial amounts of heavy elements such as iron. Under x-ray bombardment, heavy elements emit x-rays that interfere with accurate measurement of those arising from the analyte. Such a thin beryllium film or window can transmit soft x-rays emitted by sodium and elements with even lower atomic numbers (Z) and has reduced interference from heavy elements as compared with thicker beryllium films.

The film 22 and opening 18 can have various different shapes, including for example, round, rectangular, a slot, or even multiple holes of various shapes. In addition, a plurality of windows can be installed in one chamber, and the windows may be of different types.

The film 22 can be mounted directly on the support 14. While brazing has proven effective for mounting thicker windows (greater than about 30 μm), it has not proven effective for thinner windows, such as those thin enough to transmit the soft x-rays of interest. Thus, the film 22 can be mounted or attached to the support with an adhesive 26. The adhesive 26 can directly adhere the film 22 to the support 14. The adhesive can include a material capable of being baked at a temperature greater than approximately 250 degrees Celsius. For example, the adhesive can include an organic material, such as a polyimide adhesive.

The adhesive can form both a mechanical bond and chemical bond or reaction with the support 14 and the film 22. In one aspect, the support 14 can include monel, stainless steel, nickel, or kovar. The polyimide adhesive can react chemically with the nickel to form covalent bonds to hold the adhesive to the support 14. (Monel and kovar are primarily nickel, and stainless steels contain 4 to 11% Ni.) In addition, polyimide adhesive can be very polar, so it wets other polar materials, like beryllium oxide. The polyimide adhesive can have a sufficiently low viscosity, or can be prepared to have a sufficiently low viscosity, to fill grain boundary gaps in the beryllium of the film 22 by capillary action. Thus upon curing, numerous mechanical bonds will be formed.

Polyimides, however, can still allow certain gases, such as oxygen, to diffuse through them if evacuated on one side and exposed to the atmosphere on the other side. In addition, water is generated inside the polyimide as it cures. The water must be removed or sealed in, otherwise it will leak out over time and contaminate the vacuum. Long-term exposure to radiation typically exacerbates gas permeation problems.

In addition, as described above, the beryllium of the film 22 can be polycrystalline, and thus have surfaces that are not entirely smooth, but are intersected by grain boundaries. These boundaries, and other defects, can provide leakage paths, especially in thin layers as described herein. Therefore, a coating can be applied over the film 22 to seal the film and maintain the vacuum. The coating can cover leak paths in the beryllium. See for example, U.S. Pat. No. 5,226,067, which is herein incorporated by reference. In addition, the coating can be applied over exposed portions of the adhesive. The film 22, the adhesive 26 and the coating form a vacuum tight assembly capable of maintaining the substantial vacuum when one side is subject to the substantial vacuum and another side is subject to ambient pressure.

The coating can adhere to the film 22 or beryllium material. In one aspect, the coating can have at least somewhat the same polarity as the film 22 to be covered. The exposed beryllium can become covered by its native oxide, making the surface polar. In one aspect, the coating 30 and 34 can include an inorganic material, such as a boron-hydrogen or boron hydride composition of substantially boron and hydrogen. The boron-hydrogen composition can be applied by chemical vapor deposition. Other inorganic material can be used, including for example, boron nitride, boron carbide, and silicon carbide.

The coating can cover the film 22, or the exposed portions thereof, on either or both of the evacuated or ambient sides of the film. For example, a coating 30, or exterior or ambient coating, can be disposed on the ambient side of the film 22, and a coating 34, or interior or evacuated coating, disposed on the evacuated side of the film 22. In addition, the coating 30 and/or 34 can cover exposed portions of the adhesive 26 and portions of the support 14 surrounding the film, as shown. Thus, the coating can resist gas leakage through the adhesive. In one aspect, the coating 30 and 34 can be on both sides of the film 22, as shown in FIG. 1; only on the ambient side of the film, as shown in FIG. 2*c*; or only on the evacuated side of the film, as shown in FIG. 2*d*.

In addition, the film 22 can be mounted to the support 14 without any stress-relief structure. Surprisingly, the film 22 does not develop leaks even though stress concentration apparently exists. It is believed that there is a synergy between the thin film 22, the adhesive 26 or polyimide adhesive, and the coating 30 and 34 that has proven very successful. The polymeric adhesive distributes stress sufficiently to permit the use of very thin beryllium foil. The thinness of the beryllium is necessary for adequate x-ray transmission or electron transmission. Unfortunately, the thin beryllium allows slow gas leakage under differential pressure. The polymer will also transmit gas by permeation. The subsequent boron-hydride coating seals both the beryllium and the adhesive to prevent leaks and out-gassing. All of these parts maintain their important characteristics during the high-temperature bake-out (usually higher than 250 degrees Celsius) for high vacuum. This combination of parts provides a transmissive, permanently high-vacuum, high-temperature window assembly for which there has been a long felt need.

The support 14 can include an indentation 40 surrounding the opening 18. The film 22 can be disposed in the indentation 40, and the indentation 40 can have a depth greater than a thickness of the film 22 so that the film 22 is recessed within the indentation 40. The indentation 40 can create a protrusion surrounding the film 22 which can act to protect the film from contact with other objects.

The film 22 can be formed of other material, including for example, other radiation transparent material, such as polymer films, thin crystal sheets (e.g. mica), diamond films, or other inorganic films, such silicon carbide, silicon nitride, boron nitride or boron carbide.

Referring to FIGS. 2*a*–2*d*, a method for making a radiation window device or assembly 10 as described above includes mounting or attaching the film 22 to the support 14. The film 22 can be directly mounted to, or adhered to, the support 14 without any stress-relief structure. As described above, the support 14 can be formed of a metal material, such as monel, kovar, stainless steel or nickel. The support can be formed from additional manufacturing techniques, such as machining, stamping, casting, etc. In addition, as described above, the film 22 can be formed from beryllium that is rolled to the desired thickness, although other materials and fabrication techniques can be used. Beryllium foil is commercially available.

The film 22 can be mounted or attached to the support 14 with an adhesive 26. The adhesive 26 can be applied as a liquid. The liquid adhesive 26 can be applied to an area of contact between the film 22 and the support 14. For example, the liquid adhesive 26 can be applied to the support 14 around the opening 18, or in the indentation 40 of the support 14, as shown in FIG. 2*a*. The film 22 can then be disposed on the adhesive 26. Alternatively, the adhesive can be applied to the film, or to both the support and the film.

The liquid adhesive 26 can be a polymer adhesive, such as a polyimide resin or acid. The polyimide adhesive can be diluted with a solvent to lower the viscosity of the adhesive. The adhesive 26 can form a mechanical bond with the film 22, or the beryllium of the film. Thus, the adhesive 26 can have a sufficiently low viscosity to fill grain boundary gaps in the film by capillary action to form the mechanical bonds. In addition, the polyimide adhesive 26 can chemically react with the support 14, or nickel material of the support, to form covalent bonds. The adhesive 26 can undergo an initial bake-out (at a temperature of about 100 degrees Celsius) to remove the solvent from the adhesive. A pressure of about 1.5 KPa can be transmitted to the area of contact between the film and the support to create a desired adhesive thickness between the film and support for strong bonding and minimal thickness for diffusion of gases.

In addition, the adhesive can be cured at high temperature and subject to a vacuum. The temperature can be at least approximately 250 degrees Celsius, and up to at least approximately 450 degrees Celsius. Thus, the entire assembly, including the film 22 and support 14 should be capable of withstanding such temperatures.

The exposed portions of the film 22 are coated with a coating. In addition, the portions of the support 14 surrounding the film 22 can be coated, as well as exposed portions of the adhesive 26 between the film 22 and the support 14. The coating can be an inorganic material, such as a boron-hydrogen composition. The coating, or boron-hydrogen composition, can be applied by chemical vapor deposition (CVD), as is known in the art. See for example, U.S. Pat. No. 5,226,067. Other inorganic materials can also be used for the coating, including silicon carbide, silicon nitride, boron carbide, boron nitride, or CVD diamond coatings. The film 22 can include, or can be allowed to develop, its native oxide covering prior to be coated with the coating. For example, exposed beryllium can be covered by its native oxide by exposure to air, making the surface polar, and thus having somewhat the same polarity as the coating to facilitate adherence of the coating to the film.

Both sides of the film 22 can be coated with the coating 30 and 34, as shown in FIG. 1. Alternatively, only the exterior or ambient side of the film 22 can be coated with the coating 30, as shown in FIG. 2*c*. Alternatively, only the interior or vacuum side of the film 22 can be coated with the coating 34, as shown in FIG. 2*d*. The coating can seal the film 22 so that the film and coating can maintain a vacuum. In addition, the coating can provide protection to the film. Furthermore, the coating can seal the adhesive against vacuum leaks.

In some cases, the coating can inhibit additional processing (e.g. welding, soldering or brazing). Masking can prevent the coating from being deposited in those areas, or alternatively, the coating can be chemically etched or abraded from selected parts of the assembly. The widow device 10 can be mounted on other structures, such as the evacuated chamber 12 (FIG. 3).

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A window device configured to transmit radiation, the device comprising:

a) a support configured to be subject to a substantial vacuum, and having an opening configured to transmit radiation therethrough;

b) a film, mounted directly on the support across the opening, having a material and a thickness selected to transmit soft x-rays, the film having an evacuated side configured to face the substantial vacuum, and an ambient side configured to face away from the substantial vacuum;

c) an adhesive, directly adhering the film to the support;

d) a coating, covering exposed portions of at least one of the evacuated or ambient sides of the film, and covering a portion of the support surrounding the film; and e) the film, the adhesive and the coating forming a vacuum tight assembly capable of maintaining the substantial vacuum when one side is subject to the substantial vacuum; and f) the vacuum tight assembly being configured to withstand a temperature greater than approximately 250 degrees Celsius during manufacturing; and g) the support including a nickel material and the adhesive including a polyimide configured to chemically react with the nickel material of the support to form covalent bonds.

2. A device in accordance with claim 1, wherein the film is directly adhered to the support without any stress-relief structure.

3. A device in accordance with claim 1, wherein the coating also covers an exposed portion of the adhesive.

4. A device in accordance with claim 1, wherein the coating covers exposed portions of both the evacuated and ambient sides of the film.

5. A device in accordance with claim 1, wherein the adhesive includes an organic material, and wherein the coating includes an inorganic material.

6. A device in accordance with claim 1, wherein the film includes a native oxide covering that is covered by the coating.

7. A device in accordance with claim 1, wherein the film and the adhesive include polar materials, and wherein the adhesive has sufficiently low viscosity to fill grain boundary gaps in the film by capillary action to form mechanical bonds.

8. A device in accordance with claim 7, wherein the film includes a beryllium material.

9. A device in accordance with claim 1, wherein the material and the thickness of the film transmits at least 10% of incident radiation of wavelength longer than 18.5 angstroms.

10. A device in accordance with claim 1, wherein the support forms part of a sealed, evacuated chamber; and further comprising an x-ray detector or an x-ray source.

11. A device in accordance with claim 1, wherein the film includes a beryllium material having a thickness less than approximately 23 micrometers.

12. A window device configured to transmit radiation, the device comprising:

a) a support configured to be subject to a substantial vacuum, and having an opening configured to transmit radiation therethrough;

b) a film, mounted directly on the support across the opening, including a beryllium material, and having a thickness less than approximately 23 micrometers, the film having an evacuated side configured to face the substantial vacuum, and an ambient side configured to face away from the substantial vacuum;

c) an adhesive, adhering the film to the support, including a polymeric material; and d) a coating, covering exposed portions of at least one of the evacuated or ambient sides of the film, and covering a portion of the support surrounding the film, the coating including a boron-hydrogen composition; and e) the film, the adhesive and the coating forming a vacuum tight assembly capable of maintaining the substantial vacuum when one side is subject to the substantial vacuum.

13. A device in accordance with claim 12, wherein the film is directly adhered to the support without any stress-relief structure.

14. A device in accordance with claim 12, wherein the coating also covers an exposed portion of the adhesive.

15. A device in accordance with claim 12, wherein the coating covers exposed portions of both the evacuated and ambient sides of the film.

16. A device in accordance with claim 12, wherein the film includes a beryllium oxide covering that makes the surface polar and is covered by the coating.

17. A device in accordance with claim 12, wherein the support includes a material selected from the group consisting of: monel, kovar, stainless steel and nickel; and wherein the adhesive chemically reacts with the material of the support to form covalent bonds.

18. A device in accordance with claim 12, wherein the adhesive has sufficiently low viscosity to fill grain boundary gaps in the film by capillary action to form mechanical bonds.

19. A device in accordance with claim 12, wherein the film transmits at least 10% of incident radiation of wavelength longer than 18.5 angstroms.

20. A device in accordance with claim 12, wherein the support forms part of a sealed, evacuated chamber; and further comprising an x-ray detector or an x-ray source.

21. A device in accordance with claim 12, further comprising:

the vacuum tight assembly being configured to withstand a temperature greater than approximately 250 degrees Celsius during manufacturing.

22. A method for making a radiation window device, comprising the steps of:

a) applying a liquid adhesive to an area of contact between a film and a support, the film being configured to transmit soft x-rays;

b) disposing the film on the support and across an opening in the support;

c) applying a temperature greater than approximately 250 degrees Celsius to the adhesive, the film and the support to cure the adhesive; and d) coating an exposed portion of the film with an organic material on at least i) an evacuated side of the film configured to face a substantial vacuum, or ii) an ambient side of the film configured to face away from the substantial vacuum.

23. A method in accordance with claim 22, wherein the step of applying a temperature further includes applying a temperature greater than approximately 450 degrees Celsius.

24. A method in accordance with claim 22, wherein the step of applying a temperature further includes applying a substantial vacuum to the adhesive, the film and the support to cure the adhesive.

25. A method in accordance with claim 22, wherein the step of coating further includes using chemical vapor deposition to apply a boron-hydrogen composition.

26. A method in accordance with claim 24, wherein the step of coating further includes coating exposed portions of the film on both the evacuated and ambient sides of the film.

27. A method for making a radiation window device, comprising the steps of:

a) applying a liquid polymide adhesive to an area of contact between a beryllium film and a support;

b) disposing the film on the support and across an opening in the support;

c) applying a temperature greater than approximately 250 degrees Celsius to the adhesive, the film and the support to cure the adhesive; and d) coating an exposed portion of the film with a boron-hydrogen composition on at least i) an evacuated side of the film configured to face a substantial vacuum, or ii) an ambient side of the film configured to face away from the substantial vacuum.

28. A method in accordance with claim 27, wherein the step of applying a temperature further includes applying a temperature greater than approximately 450 degrees Celsius.

29. A method in accordance with claim 27, wherein the step of coating further includes using chemical vapor deposition to apply the boron-hydrogen composition.

30. A method in accordance with claim 27, wherein the step of coating further includes coating exposed portions of the film on both the evacuated and ambient sides of the film.

31. A window device configured to transmit radiation, the device comprising:

a) a support configured to be subject to a substantial vacuum, and having an opening configured to transmit radiation therethrough;

b) a film, mounted directly on the support across the opening, having a material and a thickness selected to transmit soft x-rays, the film having an evacuated side configured to face the substantial vacuum, and an ambient side configured to face away from the substantial vacuum;

c) an adhesive, directly adhering the film to the support;

d) a coating, covering exposed portions of at least one of the evacuated or ambient sides of the film, and covering a portion of the support surrounding the film; and e) the film, the adhesive and the coating forming a vacuum tight assembly capable of maintaining the substantial vacuum when one side is subject to the substantial vacuum; and f) the material and the thickness of the film being configured to transmit at least 10% of incident radiation of wavelength longer than 18.5 angstroms.

* * * * *